US011866860B2

(12) United States Patent
Hoying et al.

(10) Patent No.: US 11,866,860 B2
(45) Date of Patent: Jan. 9, 2024

(54) METHOD OF MANUFACTURING A SPORTING GOODS COMPONENT

(71) Applicant: adidas AG, Herzogenaurach (DE)

(72) Inventors: Brian Hoying, Herzogenaurach (DE); Andrew Joseph Leslie, Portland, OR (US)

(73) Assignee: adidas AG, Herzogenaurach (DE)

( * ) Notice: Subject to any disclaimer, the term of this patent is extended or adjusted under 35 U.S.C. 154(b) by 239 days.

(21) Appl. No.: 17/307,532

(22) Filed: May 4, 2021

(65) Prior Publication Data

US 2021/0254246 A1 Aug. 19, 2021

Related U.S. Application Data

(63) Continuation of application No. 16/230,712, filed on Dec. 21, 2018, now Pat. No. 11,035,060.

(30) Foreign Application Priority Data

Dec. 22, 2017 (DE) ..... 10 2017 223 743.0

(51) Int. Cl.
*D04B 1/12* (2006.01)
*A43B 23/02* (2006.01)
(Continued)

(52) U.S. Cl.
CPC ..... *D04B 1/12* (2013.01); *A43B 23/025* (2013.01); *A43B 23/042* (2013.01);
(Continued)

(58) Field of Classification Search
CPC ..... D04B 1/12; D04B 1/22; D04B 21/207; A43B 1/04; A43B 23/042
See application file for complete search history.

(56) References Cited

U.S. PATENT DOCUMENTS 2,440,393 A 4/1948 Clark
2,641,004 A 6/1953 Whiting et al.
(Continued)

FOREIGN PATENT DOCUMENTS

CN 104066350 A 9/2014
DE 102012109108 A1 3/2014
(Continued)

OTHER PUBLICATIONS

Extended European Search Report issued in European Application No. 18215284.3 dated Jun. 7, 2019, 10 pages.

*Primary Examiner* — Danny Worrell
(74) *Attorney, Agent, or Firm* — Sterne, Kessler, Goldstein & Fox P.L.L.C.

(57) ABSTRACT

A method for the manufacture of a sporting goods component including the steps of: selecting a first textile, wherein the first textile has a first shrinkage ratio under a predetermined shrinking condition; forming a first portion of the component using the first textile; selecting a second textile, wherein the second textile has a second shrinkage ratio under the predetermined shrinking condition, wherein the second shrinkage ratio is higher than the first shrinkage ratio; forming a second portion of the component using the second textile; and attaching the first textile and the second textile together.

19 Claims, 7 Drawing Sheets

(51) Int. Cl.
*D04B 21/20* (2006.01)
*A43B 23/04* (2006.01)

(52) U.S. Cl.
CPC ..... *D04B 21/207* (2013.01); *D10B 2331/10* (2013.01); *D10B 2401/041* (2013.01); *D10B 2403/0231* (2013.01); *D10B 2501/043* (2013.01)

(56) References Cited

U.S. PATENT DOCUMENTS

| | | | | |
|---|---|---|---|---|
| 4,027,406 | A | 6/1977 | Salvatore | |
| 8,959,691 | B2 | 2/2015 | Wen | |
| 10,455,885 | B2 | 10/2019 | Tamm | |
| 10,834,992 | B2 | 11/2020 | Tamm et al. | |
| 11,035,060 | B2 * | 6/2021 | Hoying ..... | A43B 23/042 |
| 2011/0177294 | A1 | 7/2011 | Rock et al. | |
| 2015/0107307 | A1 | 4/2015 | Kosui et al. | |
| 2016/0076176 | A1 | 3/2016 | Rock et al. | |
| 2017/0066212 | A1 | 3/2017 | de Backer | |

FOREIGN PATENT DOCUMENTS

| | | | |
|---|---|---|---|
| DE | 102013207153 | A1 | 10/2014 |
| EP | 2805638 | A1 | 11/2014 |
| EP | 3330420 | A1 | 6/2018 |
| TW | 200728537 | A | 8/2007 |
| TW | 200801271 | A | 1/2008 |
| WO | 2011090845 | A1 | 7/2011 |
| WO | 2015011148 | A1 | 1/2015 |
| WO | 2017142857 | A1 | 8/2017 |

* cited by examiner

METHOD OF MANUFACTURING A SPORTING GOODS COMPONENT

CROSS REFERENCE TO RELATED APPLICATION

The present application is a continuation of U.S. application Ser. No. 16/230,712, filed Dec. 21, 2018, which is incorporated herein by reference in its entirety.

TECHNICAL FIELD

The present invention relates to a method of manufacturing a sporting goods component.

PRIOR ART

Sporting good components often have a three-dimensional shape. For example, a sports shoe comprises a shoe upper and a sole. The shoe upper generally comprises a three-dimensional shape for receiving and covering a human foot. Another example is the shape of sports apparel which follows the human anatomy.

A three-dimensional shape of a sporting goods component is often obtained by joining together two-dimensional pieces. For example, a shoe upper often comprises different components like vamp, toe cap, heel counter, etc. which are stitched or glued together in a three-dimensional shape. Additionally, the shoe upper is often pulled over a last having the shape of a human foot.

This conventional method of forming a sporting goods component is time-consuming and costly due to the comparatively large number of manufacturing steps. Furthermore, sporting goods components manufactured in this way, comprise visible seams which are often detrimental to the optical appearance of the sporting good.

According to U.S. Pat. No. 4,027,406 a lasting piece of shrinkable, preferably oriented thermoplastic polymeric material is attached, preferably by stitching, to a shoe upper lasting margin and is shrunk by being heated, if it is thermoplastic, to between its glass transition temperature and melting point. Shrinkage of the lasting piece lasts the shoe upper to the last. The lasting piece can be a lasting string, endless band or strip, or a sheet, web, net or welt.

However, U.S. Pat. No. 4,027,406 does not address the general problem of how to obtain a three-dimensional sporting goods component from two-dimensional pieces. Furthermore, U.S. Pat. No. 4,027,406 is directed to general footwear and does not address the specific needs of the sports industry.

Therefore, the technical problem underlying the present invention is to provide a method for the manufacture of a sporting goods component, which is time- and cost-efficient, and allows for the manufacture of optically appealing sporting goods.

SUMMARY OF THE INVENTION

This problem is solved by a method for the manufacture of a sporting goods component comprising the steps of: selecting a first textile, wherein the first textile comprises a first shrinkage ratio under a predetermined shrinking condition; forming a first portion of the component using the first textile; selecting a second textile, wherein the second textile comprises a second shrinkage ratio under the predetermined shrinking condition, wherein the second shrinkage ratio is higher than the first shrinkage ratio; forming a second portion of the component using the second textile; and attaching the first textile and the second textile together.

According to the invention, a sporting goods component is provided with a first textile and a second textile. Both textiles differ at least by their shrinkage ratio if a predetermined shrinking condition is applied. Examples of shrinking conditions will be given below. If the shrinking condition is applied, the second textile having a higher shrinking condition will shrink more than the first textile. As both textiles are attached to each other, the different shrinkage of both textiles will lead to a deformation of the sporting goods component. If the size, shape, arrangement and shrinkage ratio of both textiles are appropriately chosen, the deformation will result in a desired shape of the sporting goods component.

Thus, the sporting goods component may be provided with a rather complex three-dimensional shape without the need to join different pieces together.

The invention also allows to pull less appealing seams in a different location where they may be covered by another piece of the sporting goods component. Examples will be given below. In this way, more appealing sporting goods components can be manufactured.

"Shrinkage ratio" in the context of the present invention is understood as the ratio of the length of a certain portion of a respective textile before and after application of the shrinking condition. For example, if a certain portion of the first textile or the second textile comprises a length of 2 cm before shrinking and 1 cm after shrinking, the shrinkage ratio is 2. Alternatively, the shrinkage ratio may be expressed as a percent value denoting by how much the portion is shrunk. For example, if the length of the portion is 1 cm before shrinking and 0.7 cm after shrinking, the shrinkage ratio is said to be 30%. A shrinkage ratio of 1 (or 0%) is possible according to the invention, i.e. the textile may not shrink at all.

The method may further comprise the step of applying the shrinking condition. This causes the second textile to shrink more than the first textile, because its shrinkage ratio is higher. As both textiles are attached to each other, a tension force is created within the sporting goods component resulting in a deformation.

The application of the shrinking condition may provide the sporting goods component with a three-dimensional shape. In this way, a three-dimensional sporting goods component can be obtained from a flat two-dimensional shape simply by applying the shrinking condition. In other embodiments, a three-dimensional sporting goods component may be modified from a three-dimensional shape to another different three-dimensional shape simply by applying the shrinking condition.

The shrinking condition may comprise the application of heat and/or water. Water may include water in liquid form, as steam or as vapor. Heat and water are readily available and their application is rather simple.

The first textile may be a knit and/or the second textile may be a knit. Knitted fabrics are well suitable for sporting goods components such as shoe uppers, but also for sports apparel. Moreover, yarns with different shrinkage ratios can be used by knitting machines to obtain the first and second textiles in a fully automated manner.

The method may further comprise the step of forming the first portion and the second portion of the component during the same knitting process. Thus, a one-piece seamless knit fabric is obtained, thereby providing a simple cost-efficient manufacturing, and also a good looking finished product. Besides, such knit component may be obtained on a flat-knitting machine and may be provided with a three-dimensional shape when subjected to the application of the shrinking condition.

The method may further comprise the step of attaching the first portion and the second portion to each other by loops of knitting during the knitting process. As mentioned above, this technique avoids seams between the two portions. Nonetheless and according to the invention other methods of attaching the first and the second portion may be used such as stitching, gluing, melting, etc.

The method may further comprise the steps of forming the first portion at least partially by a first knitting row and forming the second portion at least partially by a second knitting row. In this way, the two different textiles can be incorporated into the sporting goods component for example by changing the yarn on a knitting machine after the first row has been knitted.

The first portion of the component may be obtained by using a first selection of yarn or yarns on a first needle and the second portion of the component may be obtained by using a second selection of yarn or yarns on a second needle, wherein the second needle forms loops side by side with loops formed by the first needle, and the second selection of yarn or yarns comprises a higher shrinkage ratio than the first selection of yarn or yarns. Such a setup decreases production time because both textiles can be incorporated into the sporting goods component at the same time.

The method may further comprise the step of forming the first textile and the second textile by small circular knitting. Small circular knitting is a technique which allows to manufacture a single circular knit portion with a diameter adapted to the final shape of the component. Compared to conventional circular knitting or flat knitting, no additional cutting step is needed. Furthermore, as the result is a three-dimensional circular knit portion, no additional sewing step is needed to form a two-dimensional flat component into a three-dimensional component. In addition, by application of the shrinking condition, the circular knit portion may further be formed into the desired shape.

The first textile and the second textile may be knitted in a single small circular knitting process to obtain a tube comprising the first portion and the second portion. The shape of the tube may then be locally modified by the method according to the invention.

The second shrinkage ratio may be higher than the first shrinkage ratio by at least 10%. In particular, the shrinkage ratio may be at least 20%.

The sporting goods component manufactured according to the method described herein may in particular be a shoe upper for a sports shoe. As mentioned above, shoe uppers are usually made from two-dimensional pieces sewn or glued together. These steps can be omitted when using the method according to the invention.

A further aspect of the present invention relates to a sporting goods component comprising: a first portion with a first shrinkage ratio under a predetermined condition; and a second portion with a second shrinkage ratio under the predetermined condition. As described above, such a sporting goods component may be have a rather complex three-dimensional shape without the need to join different pieces together. The invention also allows to pull less appealing seams in a different location where they may be covered by another piece of the sporting goods component. Examples will be given below.

The sporting goods component may comprise a three-dimensional shape caused at least in part by a difference of the first shrinkage ratio and the second shrinkage ratio. In this way, a three-dimensional sporting goods component can be obtained from a flat two-dimensional shape. Also, a three-dimensional sporting goods component can be obtained from a three-dimensional shape, for example a complex three-dimensional sporting goods component may be obtained from a tubular component.

The sporting goods component may be a shoe upper. As mentioned above, shoe uppers are usually made from two-dimensional pieces sewn or glued together. These steps can be omitted when manufacturing a shoe upper according to the invention which may therefore be manufactured with less time, effort and costs.

The shrinking condition may comprise the application of heat and/or water. Heat and water are readily available and their application is rather simple.

The first portion may comprise a knit textile and/or the second portion may comprise a knit textile. Knitted fabrics are well suitable for sporting goods components such as shoe uppers, but also for sports apparel. Moreover, yarns with different shrinkage ratios can be used by knitting machines to obtain the first and second textiles in a fully automated manner.

The first knit textile and the second knit textile may be portions of a one-piece knit. Thus, the sporting goods component comprises a one-piece seamless knit fabric which may even be originally flat, but which is provided with a three-dimensional shape subject to the application of the shrinking condition.

The first portion and the second portion may have been attached to each other by loops of knitting during a knitting process. As mentioned above, this technique avoids seams between the two portions.

The first portion may be formed at least partially by a first knitting row and the second portion may be formed at least partially by a second knitting row. In this way, the two different textiles can be incorporated into the sporting goods component for example by changing the yarn on a knitting machine after the first row has been knitted.

The first textile and the second textile may have been formed by small circular knitting. As mentioned above, small circular knitting is a technique which allows to manufacture a single circular knit portion at a time with the correct size and shape. Compared to conventional circular knitting or flat knitting, which produce several components (i.e. shoe uppers or parts of it) at once, no additional cutting step is needed. Furthermore, as the result is a three-dimensional circular knit portion, no additional sewing step is needed to form a two-dimensional flat component into a three-dimensional component. In addition, by using textiles with different shrinking conditions, the circular knit portion may further be formed into the desired shape of the final sporting goods component.

According to an aspect of the inventive idea of the present invention, a shrinking yarn is incorporated in a sporting goods component, such that when the sporting good is worn, the shrinking yarn surrounds a portion of a human body. For example, the shrinking yarn may be wrapped around a toe portion of a shoe upper, such that it surrounds a human foot when a shoe comprising the shoe upper is worn.

By the application of a shrinking condition, as described herein, the shrinking yarn may shrink and provide the sporting goods component with a desired shape. In the example above, the shoe upper may be provided with a smaller diameter at the toe portion compared for example to the midfoot portion.

The sporting goods component may comprise a base material and the shrinking yarn. The shrinking yarn may have a higher shrinkage ratio than the base material when applying the shrinking condition. For example, the base material may be a textile, leather or artificial leather.

The sporting goods component may be a shoe upper. As described above, the shoe upper may be provided with the desired shape simply by the application of the shrinking condition.

The sporting goods component may be a sports apparel. For example, the shrinking yarn may be arranged, such that it surrounds a waist of a human body when worn. In this way, the apparel may be provided with a good fit to the human body.

BRIEF DESCRIPTION OF THE DRAWINGS

The presently preferred embodiments of the method according to the invention as well as of a sporting goods component according to the invention are described in the following detailed description, with reference to the following drawings.

DETAILED DESCRIPTION OF PREFERRED EMBODIMENTS

Figure 1A:
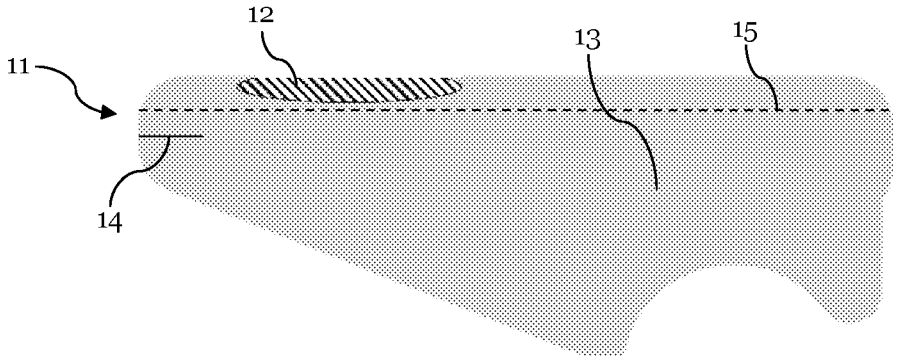
FIGS. 1A and 1B illustrate an exemplary shoe upper according to the invention.
Figure 1B:
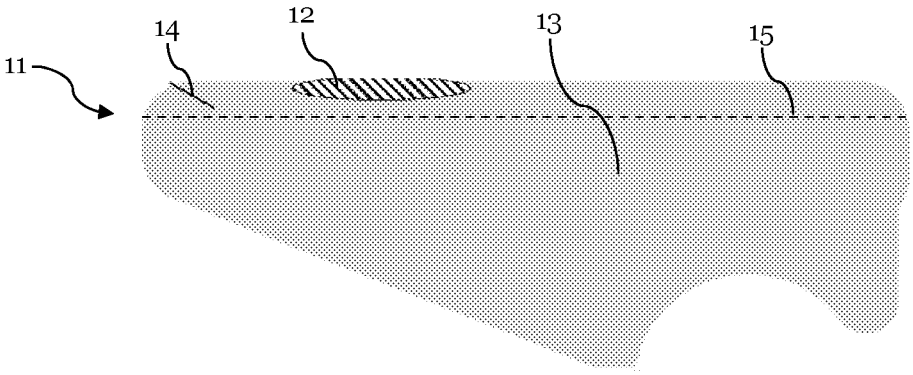

FIGS. 1A and 1B show an exemplary sporting goods component, namely an upper 11 for a sports shoe. In general, the present invention is applicable to all types of sporting goods, such as for example sports apparel. According to the exemplary embodiment of FIGS. 1A and 1B, the shoe upper 11 is created by small circular knitting. Small circular knitting is a technique which allows to manufacture a single circular knit portion at a time with the correct size and shape. Compared to conventional circular knitting or flat knitting, in which several components (i.e. shoe uppers or parts of it) are produced at once, no additional cutting step is needed.

Thus, the shoe upper 11 is initially a small circular knit sock. The upper 11 comprises a shrinking zone 12 that will shrink more than the rest 13 of the sock when heat is applied to the knit. In particular, in the currently preferred embodiment of the invention, the shrinking portion 12 is placed at the bottom portion of the forefoot portion of the sock. That way some portions such as the seam 14 at the front of the sock may be pulled toward below the sock, so that it is hidden when the shoe upper is then joined with a sole (not shown in FIGS. 1A and 1B).

After shrinking of the portion 12, the shoe upper 11 will be deformed in the forefoot portion such that the front seam 14 is arranged below the shoe upper 11. The joining line that separates the portion of the shoe upper 11 that will be visible on the final product and the portion of the upper 11 that will be joined to the sole unit is indicated by dashed lines 15. After shrinking, the seam 14 is below the joining line such that it cannot be seen on the final product.

The method may be applied to any knit textile, in particular a flat knit textile, or to any other material. One or the other of the textiles may be a knit, mesh, woven, braid, or non-woven.

Figure 2A:
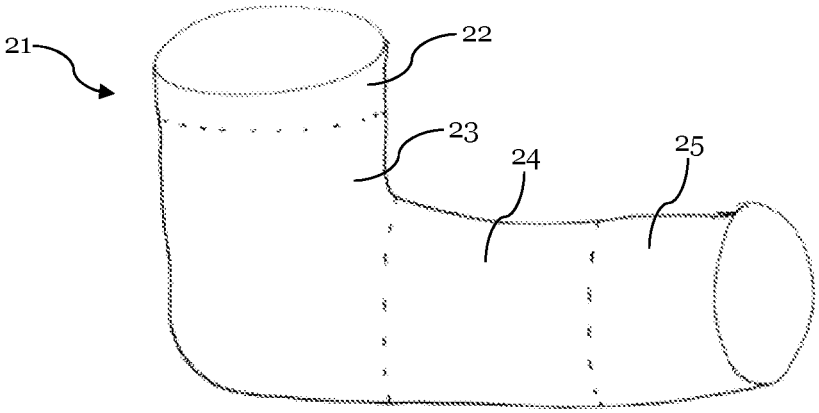
FIGS. 2A and 2B illustrate an exemplary embodiment according to the invention applicable to a shoe upper.
Figure 2B:
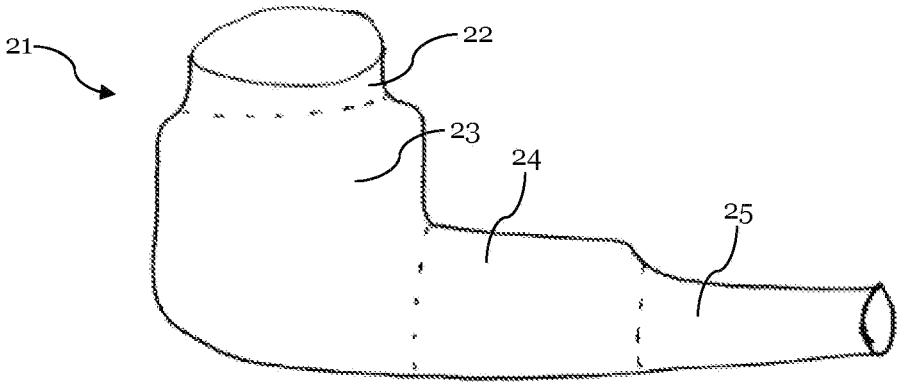

The area in which the higher shrinkage ratio is designed may be in a different place than in the above example of FIGS. 1A and 1B. In particular, it may be in a plurality of portions with different sizes and shapes. Also, more than two areas may each have a different shrinkage ratio. The shrinkage ratio may also change gradually, for example by changing gradually the proportions of shrinking yarn in a knit. This way a small circular knit tube may be pre-formed to a shoe shape as illustrated in FIGS. 2A and 2B.

In this example, a small circular knit tube 21 comprises four different zones 22, 23, 24 and 25, each having a different shrinkage ratio. As illustrated in FIG. 2B, the toe zone 25 has the highest shrinkage ratio, whereas ankle zone 23 has the lowest shrinkage ratio. Of course, the number of zones, the arrangement of the zones, as well as the shrinkage ratios may vary.

Generally, shrinking yarns may be used in the context of the present invention. A shrinking yarn may for example be based on polyamides, polyesters, poly-acrylonitriles or vinyl polymers, olefin polymers, TPU, wool-felted, Lycra®, yarns comprising rubber in their content, and biomimetic yarn such as spider-silk yarn obtained by bio-engineering (e.g. produced by genetically modified bacteria).

In some embodiments, a PES yarn may be used in a portion that is to shrink only slightly (for example between 1% and 5%), and a mix of PES and Lycra yarn may be used in shrinking portions with a higher shrinkage ratio (for example between 5% and 30%, in particular between 10% and 20%).

One of the advantages of the invention is that a one size basic component may shrink to different percentages so as to obtain different sizes of the final sporting good. This is particularly advantageous in small circular knitting where the number of needles is fixed, and therefore the diameter of the tube obtained is in principle also fixed. But varying the shrinkage ratio, and/or the size, and/or the shape, and/or the arrangement of the shrinking portion(s), and/or the shrinking conditions (in particular the duration of application), permits to obtain different sizes and shapes.

In an example, a sock obtained by small circular knitting is to be used as a sports shoe upper. The size of the sock as it is taken out of the small circular knitting machine corresponds to European shoe size 40. By selectively adding a shrinking yarn during the knitting process and applying a shrinking condition, it is possible to shrink the sock, such that it corresponds to smaller shoe sizes, such as 39, 38, 37, etc.

Figure 3:
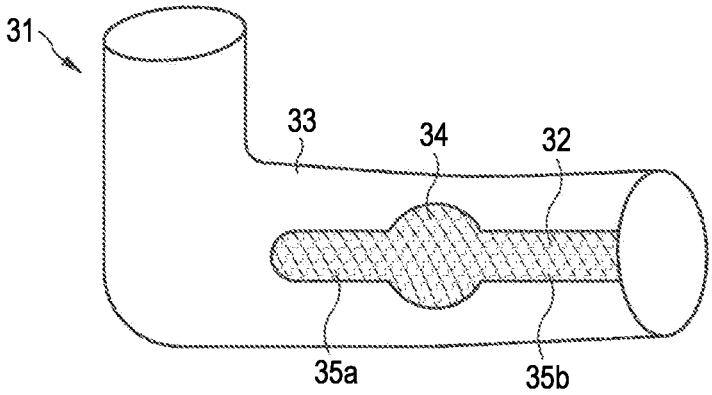
FIG. 3 illustrates a further exemplary embodiment according to the invention applicable to a shoe upper.

Generally, the shrinking portion may have a varying width over a dimension of the shoe upper, such that one portion will become smaller than other portions as illustrated in FIG. 3. In this example, a tube 31 to be used for a shoe upper comprises a shrinking portion 32 which has a higher shrinkage ratio than other portions 33 of the tube 31. The width of the shrinking portion 32 varies over its length. The middle section 34 of the shrinking portion 32 is rather large compared to its end portions 35*a* and 35*b*. Thus, when applying the shrinking condition, the tube 31 will obtain a smaller diameter in the area of the middle section 34 of the shrinking portion 32 compared to the areas of the end portions 35*a* and 35*b* of the shrinking portion 32. Such middle section 34 may for example correspond to the foot arch portion of a sock or shoe upper.

A shrinking area, zone or portion according to the invention is understood as an area that shrinks more than another area of the sporting goods component (for example a shoe upper). For example, the shrinking area, zone or portion may be knit and comprises a higher proportion of a shrinking yarn. It may be that other areas have less percentage of shrinking yarn, or have no shrinking yarn at all.

In some embodiments, a sporting goods component may comprise two overlapping layers of textiles, wherein a first layer comprises a lower shrinkage ratio than a second layer. The two layers may be bonded to each other or only attached at some points (for example at their edges). The behavior of the portion will thus be different whether the two layers are bonded or not. The first (less shrinking) layer may be a stretch layer with a high degree of elasticity.

Figure 4A:
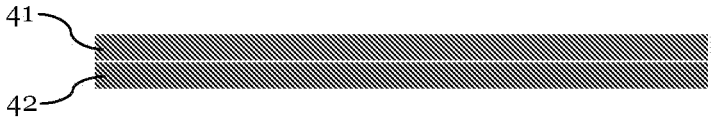
FIGS. 4A and 4B illustrate an exemplary embodiment of the present invention using layers with different shrinkage ratios.
Figure 4B:
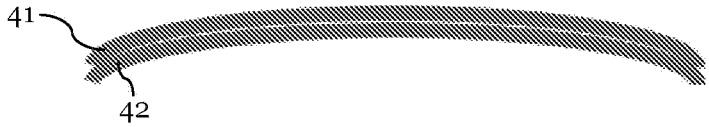

An example of overlapping layers with different shrinkage ratios is provided in FIGS. 4A and 4B. In this example, the upper layer 41 comprises a lower shrinkage ratio than the lower layer 42. Thus, when the shrinking condition is applied as illustrated in FIG. 4B, the lower layer 42 shrinks more than the upper layer 41 and "pulls" both layers into a bent shape.

Figure 5A:
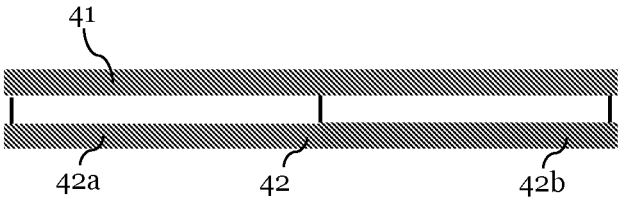
FIGS. 5A and 5B illustrate a further exemplary embodiment of the present invention using layers with different shrinkage ratios.
Figure 5B:
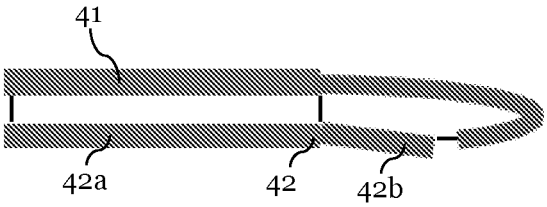

Another example is provided in FIGS. 5A and 5B. In this example, the upper layer 41 and the left portion 42*a* of the lower layer 42 are formed from a textile having a comparatively low shrinkage ratio. Both layers may for example form a spacer knit or the two layers may be attached by loose stitch for example. The right portion 42*b* of the lower layer 42 is formed from a textile having a comparatively high shrinkage ratio. As illustrated in FIG. 5B, after application of the shrinking condition, the portion 42*b* pulls a part of the upper layer 41 into a bent configuration.

Figure 6A:
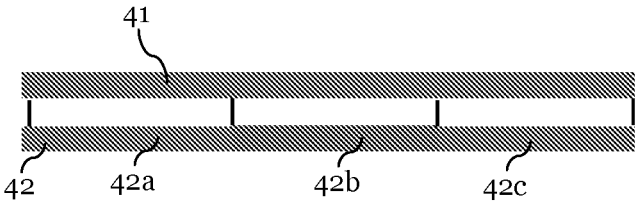
FIGS. 6A and 6B illustrate a still further exemplary embodiment of the present invention using layers with different shrinkage ratios.
Figure 6B:
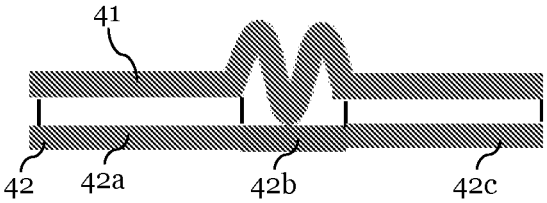

A further example is illustrated in FIGS. 6A and 6B. In this example, the upper layer 41, the left portion 42*a* and the right portion 42*c* of the lower layer 42 are formed from a textile having a comparatively low shrinkage ratio. The middle portion 42*b* of the lower layer 42 is formed from a textile having a comparatively high shrinkage ratio. As illustrated in FIG. 6B, after application of the shrinking condition, the combination of the two layers 41 and 42 produces a texturing effect on the upper layer 41. The upper layer 41 may for example be an outer layer of a shoe upper.

Generally, according to the invention, the activation of the shrinking may be provoked by different elements. The shrinking may be activated by heat, by water (liquid, vapor or steam), and/or any combination. The heat may be provided as electromagnetic waves in many different wavelengths: IR, microwave, radio-frequency, etc. so as to warm up the sporting goods component such as a shoe upper.

The activation may be applied on the whole sporting goods component (such as a shoe upper) or locally. For example, heat or steam may be applied very locally with a nozzle, either manually or automatically (e.g. with a robotic arm). Nonetheless the invention is particularly advantageous when the activation is applied to the entire sporting goods component (such as a shoe upper): the process is then more simple and cheaper as it may require less complex machines and less labor. Indeed, the entire shoe upper may be passed in an oven for example.

In case of a shoe upper, the shrinking is beneficially made when the shoe upper is lasted. Nonetheless it may be made when the shoe upper is not lasted. If the shoe upper is lasted, heat may be transferred to the shoe upper via the last to activate the shrinking process. To this end, the last may comprise a heating element, such as heating wires or may allow the passage of a hot medium such as water or oil, or may comprise steam nozzles.

According to the invention, other portions with different characteristics may be integrated in a shoe upper for a sports shoe (or sports apparel). For example, a portion may have a higher elasticity than another one. This may be obtained by using a higher proportion of an elastic yarn (in a knit or a woven for example). More particularly, an elastic yarn may be integrated in the shrinking area, in combination with a shrinking yarn. By doing so, the elastic yarn may be able to pull on the shrinking area when the shrinking yarn is "activated" so as to accelerate the shrinkage and/or obtain shrinkage with a lighter activation (e.g. at a lower temperature) and/or with a lower proportion of shrinking yarn than would be needed without the elastic yarn.

The shrinking area may also be combined with a second different area made to be auxetic. Auxeticity may be obtained by the geometry and/or material of the second area. The shrinking area and the auxetic area may be placed on the shoe upper such that when the shrinking area shrinks it pulls the auxetic material in one direction. As a consequence of this pull along one direction the auxetic area also extends in a second direction.

The method according to the invention may generally also be used for apparel.

One other advantage of embedding shrinking areas is that these areas may become stiffer. Therefore, they can form a local reinforcement such as a heel counter or a toe cap. They may also improve abrasion resistance. It is particularly the case with knit textile whereby the shrunk knit portion has smaller and tighter loops. Besides, the shrunk portion may also be more water-repellant as the holes between the loops are smaller. Combined with a water-repellant yarn (e.g. water-repellant coated yarn), the holes may be small enough to stop water intake, even in a knit.

The shrinking portions or parts thereof, such as for example a shrinking yarn may be removed in a further manufacturing step. For example, it may be a shrinking patch or a shrinking yarn attached at intervals to a base layer so as to deform it when shrinking, and the base layer is then locked in place or set in its shape, and the shrinking portion is then removed. Also, the shrinking portion may be cut-off for example a shoe upper in a subsequent manufacturing step. More particularly an outer-periphery of the shoe upper that would be made more shrinking than other portions of the shoe upper may be cut-off in a subsequent step.

Figure 7A:
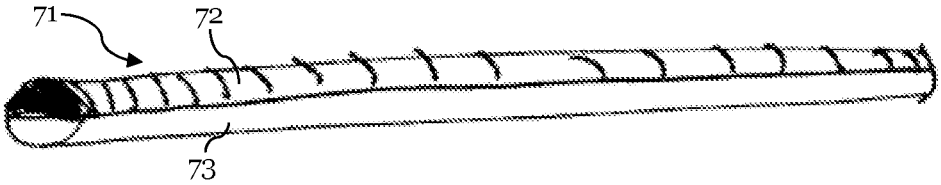
FIGS. 7A and 7B illustrate an exemplary embodiment of a yarn according to the present invention.
Figure 7B:
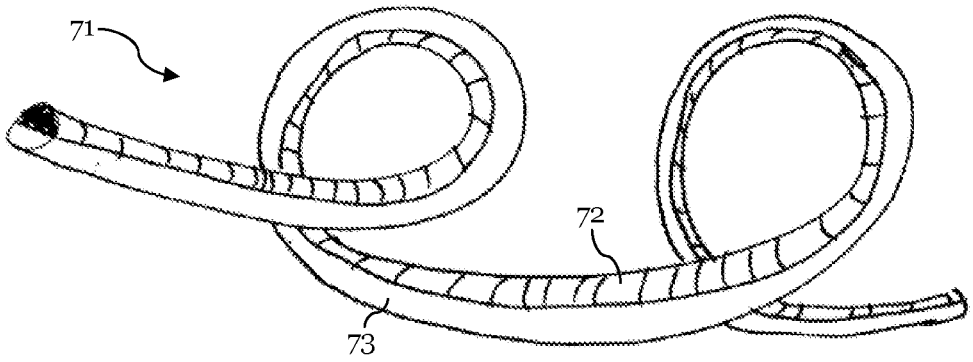

A specific shrinking yarn may comprise two different grades of material such that a portion of the yarn will shrink more than another portion of the yarn. An illustrative example of such a yarn 71 in provided in FIGS. 7A and 7B. The yarn 71 comprises a first portion 72 with a comparatively high shrinkage ratio and a second portion 73 with a comparatively low shrinkage ratio. As illustrated in FIG. 7B, after the application of the shrinking condition, the yarn 71 is in a curled configuration.

The yarn 71 may be obtained by co-extrusion of two different materials—or two different grades of a same material—with different shrinkage ratio under the same predetermined conditions. Such yarn 71 would curl as illustrated in FIG. 7B and thereby exert a pulling force. If such yarn 71 is embedded in a textile such as a knit, it will exert its pulling force on the textile, thereby deforming the textile.

Figure 8A:
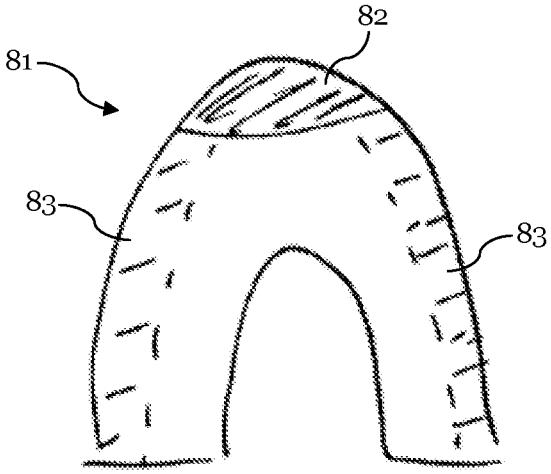
FIGS. 8A and 8B illustrate an exemplary shoe upper according to the invention.
Figure 8B:
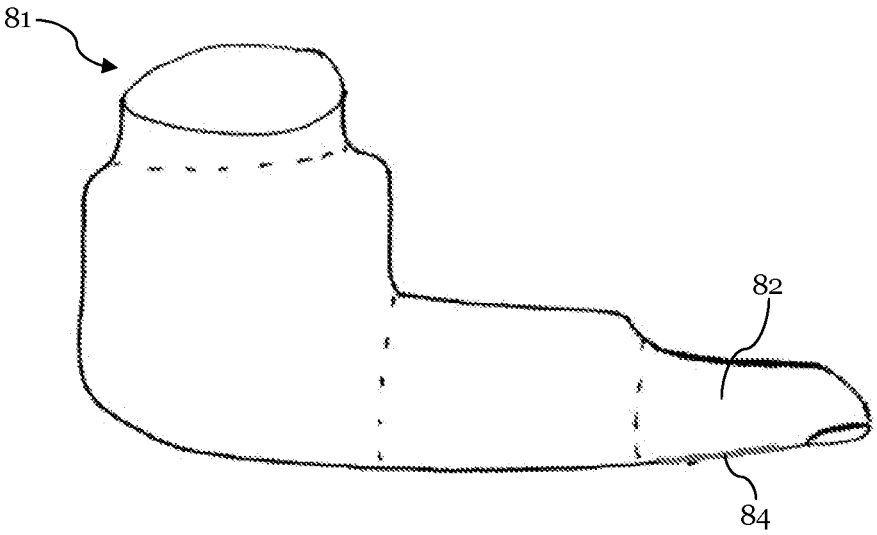

FIGS. 8A and 8B illustrate a location where a shrinking portion 82 may be placed in a shoe upper 81, namely in the toe area. As illustrated in FIG. 8B, after application of the shrinking condition, the toe area comprises a smaller diameter than the rest of the shoe upper which comprises a lower shrinking condition. Another possible location for a shrinking area is the outer periphery 83 of a shoe upper.

It is also possible to apply a shrinking condition more than once. For example, as illustrated in FIG. 8B, a second step may be applied after having obtained the shoe support of FIG. 2B by a first shrinking step, to shrink an area 84 below the toe portion. In an example, the area 84 may comprise a yarn with a higher activation temperature compared to the area 82. In another example, the area 82 is activated by heat, whereas the area 84 is activated by water or vice versa.

In an optional step of the invention, a mask may be applied to at least a portion of the sporting good component (such as a shoe upper), such that it does not receive the application of the shrinking condition. Such portion may thus remain un-shrunk or may be shrunk at a later stage. For example, a mask may protect at least one portion from heat application.

Figure 9A:
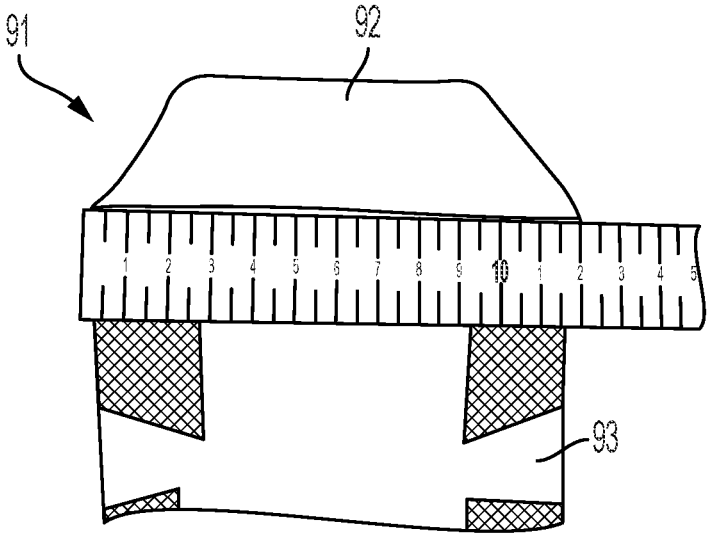
FIGS. 9A, 9B and 9C show an exemplary shoe upper according to the invention.
Figure 9B:
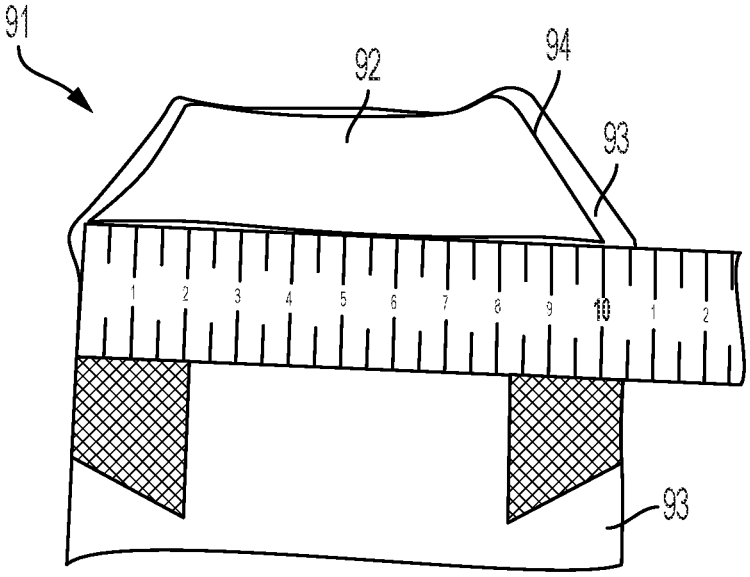
Figure 9C:
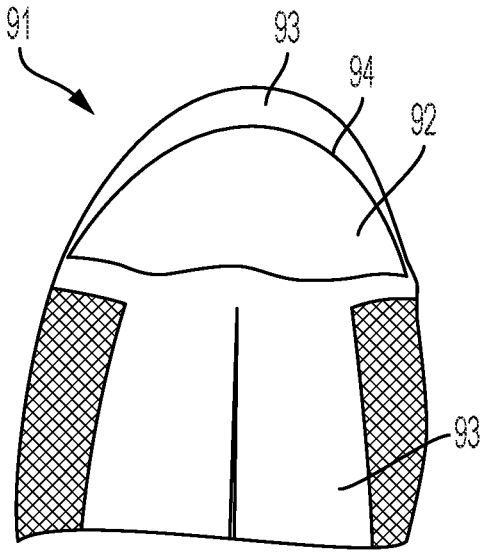

FIGS. 9A, 9B and 9C show another exemplary embodiment of the present invention, namely a shoe upper 91 for a sports shoe. In this exemplary embodiment, a TPU yarn has been used to create a shrinking zone 92. The shrinking zone 92 has been created in the bottom portion of the forefoot (or "toe") area of a knitted, sock-like shoe upper 91 (for example obtained by small circular knitting). FIG. 9A shows a bottom view of the knitted sock-like upper 91 before shrinkage. FIGS. 9B and 9C show the shrinking thus obtained. As can be seen, a portion 93 of the shoe upper 91 not comprising the shrinking TPU yarn is pulled under a portion of the toes.

More particularly, FIG. 9B shows the upper 91 after the application of steam, in a flat configuration. The zone 92 knitted with TPU yarn shrank from 12 cm to 10 cm, as indicated with the ruler. It can be seen that the seam lines 94 (between the zones 92 and 93) have been pulled toward the bottom surface of the shoe upper 91, such that if the shoe upper 91 is joined to a bottom unit, the seam lines will not be visible anymore.

FIG. 9C shows the upper 91 after the application of steam, with the shoe upper 91 having been placed on a last. Here again the seam lines 94 have been pulled towards the bottom surface of the shoe upper 91.

The yarn proportions in this specific example are as follow: 100% PES in the area 93 and 100% TPU in the area 92. However, similar behavior would be seen with material blends and especially using some materials which could be engineered with higher shrinkage levels. Additionally, material blends are advantageous to maintain a combination of properties in the shrinkage zones, for example to maintain bonding behavior or comfort.

Figure 10:
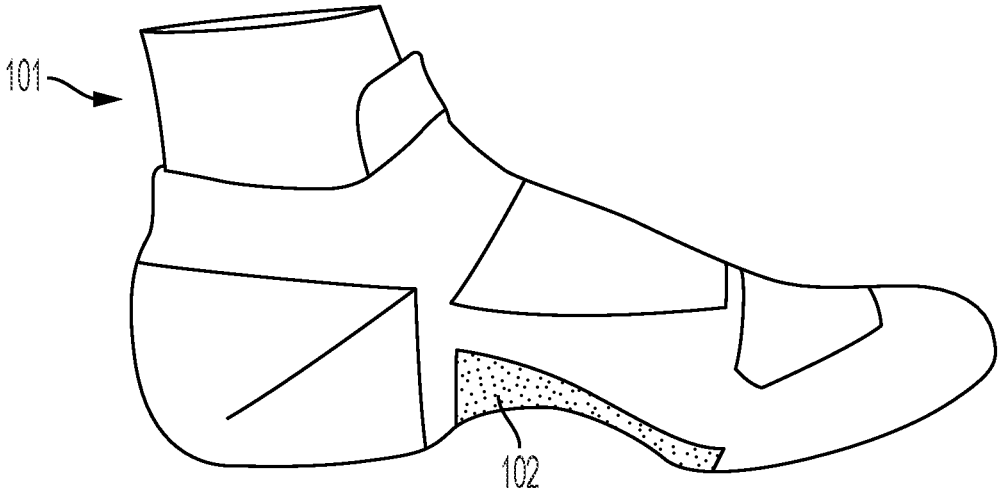
FIG. 10 shows another exemplary shoe upper according to the invention.

FIG. 10 shows another exemplary embodiment of the present invention, namely a shoe upper 101 with a shrinking portion 102 in the lower midfoot (or arch) region. In this example, the shrinking portion 102 helps to form the upper 101 around the concave shape of the midfoot, thus providing support to a foot of a wearer of the final sports shoe and generally improving the shape and fitting to the foot.

Figure 11A:
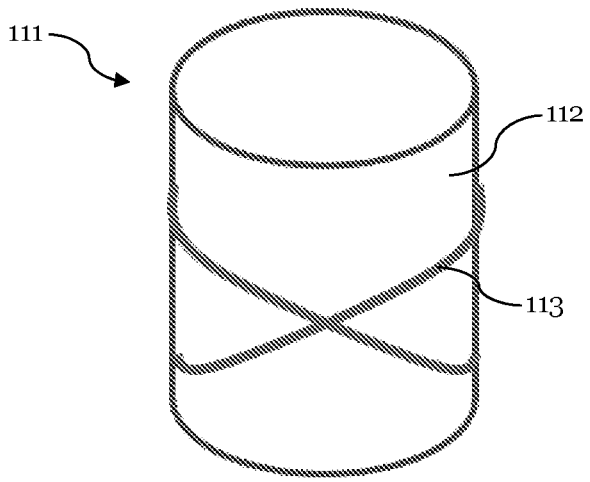
FIGS. 11A and 11B illustrate an exemplary embodiment according to the inventive idea of the present invention.
Figure 11B:
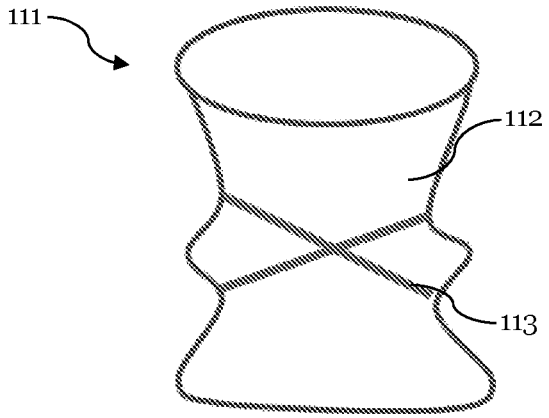

According to an aspect of the inventive idea of the present invention, a shrinking yarn is incorporated in a sporting goods component, such that when the sporting good is worn, the shrinking yarn surrounds a portion of a human body. This principle is generally illustrated in FIGS. 11A and 11B which show a cylindrical shape 111. The cylindrical shape 111 is generally made from a first material 112. The middle of the cylinder comprises a shrinking portion or zone which additionally comprises a second material 113 in form of a yarn which shrinks by the application of a certain shrinking condition, e.g. the application of heat above a certain temperature or the application of water. The first material 112 does generally not shrink by the application of the shrinking condition or does not shrink as much as the shrinking yarn. After the application of the shrinking condition, the middle of the cylindrical shape is constricted due to the yarn 113 which has become shorter as illustrated in FIG. 11B.

Generally, for this aspect of the idea of the present invention, one of the shrinking yarns described above may be used. The material 112 used for the sporting goods component may be a textile (such as a knit), leather or artificial leather.

What is claimed is:

1. A sporting goods component, comprising:

a first portion attached to a second portion such that the sporting goods component has a first shape;

wherein the first portion comprises a first textile having a first shrinkage ratio under a predetermined shrinking condition; and wherein the second portion comprises a second textile having a second shrinkage ratio under the predetermined shrinking condition, wherein the second shrinkage ratio is higher than the first shrinkage ratio such that when the predetermined shrinking condition is applied, the sporting goods component changes from the first shape to a second shape that is different than the first shape.

2. The sporting goods component according to claim 1, wherein the first shape is a two-dimensional shape.

3. The sporting goods component according to claim 1, wherein the second shape is a three-dimensional shape.

4. The sporting goods component according to claim 1, wherein the predetermined shrinking condition comprises application of heat or water to the sporting goods component.

5. The sporting goods component according to claim 1, wherein at least one of the first portion and the second portion comprises a knit textile.

6. The sporting goods component according to claim 1, wherein the first portion and the second portion are attached to each other by loops of knitting.

7. The sporting goods component according to claim 1, wherein the first portion is formed at least partially by a first knitting row and the second portion is formed at least partially by a second knitting row.

8. The sporting goods component of claim 1, wherein the first portion overlaps with the second portion.

9. The sporting goods component of claim 1, wherein the second shrinkage ratio is higher than the first shrinkage ratio by at least 10%.

10. The sporting goods component of claim 1, wherein the first portion and the second portion are portions of a tubular component.

11. A shoe upper, comprising:

a knit textile comprising a plurality of portions attached to one another such that the shoe upper has a first shape, wherein each of the plurality of portions comprises a textile having a different shrinkage ratio under a predetermined shrinking condition, such that when the predetermined shrinking condition is applied, the shoe upper changes from the first shape to a second shape that is different than the first shape due to the difference in the shrinkage ratios of each of the plurality of portions.

12. The sporting goods component of claim 11, wherein the first shape is a tubular shape.

13. The sporting goods component of claim 11, wherein the second shape is a three-dimensional shape.

14. The sporting goods component of claim 11, wherein the knit textile comprises a sock.

15. The sporting goods component of claim 11, wherein the knit textile comprises a base textile and a shrink yarn.

16. The sporting goods component of claim 11, wherein at least one of the plurality of portions comprises an elastic yarn.

17. The sporting goods component of claim 11, wherein the plurality of portions comprises a toe portion.

18. The sporting goods component of claim 17, wherein the plurality of portions comprises an ankle portion.

19. The sporting goods component of claim 11, wherein a first portion of the plurality of portions comprises a higher proportion of a shrink yarn than a second portion of the plurality of portions.

* * * * *